United States Patent [19]

Müller

[11] 4,299,378

[45] Nov. 10, 1981

[54] APPARATUS FOR SINGULARIZING AND OPENING STACKED FOLDED SHEETS

[75] Inventor: Hans Müller, Zofingen, Switzerland

[73] Assignee: Grapha-Holding AG, Hergiswil, Switzerland

[21] Appl. No.: 125,356

[22] Filed: Feb. 28, 1980

Related U.S. Application Data

[63] Continuation of Ser. No. 906,783, May 17, 1978, abandoned.

[30] Foreign Application Priority Data

May 30, 1977 [CH] Switzerland ..... 6548/77

[51] Int. Cl.[3] ..... B65H 39/02

[52] U.S. Cl. ..... 270/54

[58] Field of Search ..... 270/54–58

[56] References Cited

U.S. PATENT DOCUMENTS

| | | | |
|---|---|---|---|
| 2,251,943 | 8/1941 | Kleineberg | 270/54 |
| 2,413,358 | 12/1946 | Kleineberg | 270/54 |
| 3,087,721 | 4/1963 | McCain | 270/54 |
| 3,809,384 | 5/1974 | Zugel | 270/54 |

*Primary Examiner*—J. Reed Fisher
*Assistant Examiner*—A. Heinz
*Attorney, Agent, or Firm*—Peter K. Kontler

[57] ABSTRACT

Apparatus for singularizing and opening stacked folded sheets, wherein one marginal portion of each sheet opposite the fold projects beyond the adjacent marginal portion, has a magazine for a stack of such sheets, a rotary drum which withdraws successive sheets from the magazine in such a way that the two marginal portions are located at the lower end of the withdrawn sheet, two rotary opening devices mounted below the drum and having grippers for the marginal portions of the withdrawn sheet, and a plate-like straightening device which is mounted between the opening devices and is pivoted against the marginal portions of the withdrawn sheet to flatten the projecting marginal portion and to place the flattened marginal portion into the path of movement of the gripper on one of the opening devices. The straightening device is thereupon withdrawn to allow the shorter marginal portion to move into the path of movement of the gripper of the other opening device. The purpose of the straightening device is to insure predictable engagement of the gripper of the one opening device with the projecting marginal portion of the withdrawn sheet even if such projecting marginal portion was deformed during the preceding stage or stages of manipulation of the respective sheet.

10 Claims, 3 Drawing Figures

APPARATUS FOR SINGULARIZING AND OPENING STACKED FOLDED SHEETS

This is a continuation of application Ser. No. 906,783, filed May 17, 1978, now abandoned.

BACKGROUND OF THE INVENTION

The present invention relates to apparatus for manipulating sheets, and more particularly to improvements in apparatus for manipulating folded sheets. Still more particularly, the invention relates to apparatus for singularizing folded sheets which form a stack and must be opened up or spread apart for further processing in a bookbinding or like machine, and wherein one marginal portion of one of the two panels of each sheet projects beyond the corresponding marginal portion of the other panel.

As a rule, folded sheets of the above outlined character are processed in an apparatus wherein a continuously rotating drum withdraws successive sheets from a magazine and positions the aforementioned marginal portions of the two panels of each withdrawn sheet in the path of movement of opening or spreading drums which are provided with clamping or gripping devices. The clamping device or devices of one spreading drum engage the projecting marginal portion, and the clamping device or devices of the other spreading drum engage the other marginal portion prior to movement of the clamping devices away from each other to thus open the sheet preparatory to transfer onto a conveyor which delivers the sheets to a further processing station. The clamping device of devices of the one spreading drum engage the respective (projecting) marginal portion before the other marginal portion is engaged by the clamping device or devices of the other spreading drum.

Such apparatus operate properly as long as the marginal portions (especially the projecting marginal portions) of the panels which form part of withdrawn sheets are not deformed, e.g., folded, curled or otherwise moved out of requisite or anticipated position. The likelihood that the projecting marginal portion will undergo undesirable deformation which prevents the corresponding clamping device or devices from engaging the deformed projecting marginal portion is especially pronounced when the sheets are relatively thin and readily flexible. Failure of the clamping device or devices of the one spreading drum to engage a deformed projecting marginal portion results in unpredictable transport of the respective sheet and causes lengthy interruptions of operation.

OBJECTS AND SUMMARY OF THE INVENTION

An object of the invention is to provide an apparatus for manipulating folded sheets wherein one marginal portion of one panel extends or projects beyond the corresponding marginal portion of the other panel, the apparatus being constructed and assembled in such a way that it can properly process folded sheets even if the projecting or both marginal portions are deformed prior to stacking, in the stack or during withdrawal from the stack.

Another object of the invention is to provide the apparatus with novel and improved means for insuring predictable positioning of projecting marginal portions of successive folded sheets preparatory to spreading or opening up of such sheets.

A further object of the invention is to provide an apparatus of the above outlined character which can be installed in existing bookbinding and other sheet processing machines as a superior substitute for existing apparatus.

An additional object of the invention is to provide an apparatus which can properly manipulate folded sheets which are not exactly identical with each other.

The invention is embodied in an apparatus for spreading or opening successive sheets of a series of stacked folded sheets wherein each sheet comprises first and second panels having first marginal portions which are integral with each other and second marginal portions which are substantially parallel to the first marginal portions and wherein the second marginal portion of the first panel projects beyond the second marginal portion of the second panel. The apparatus comprises a magazine for a stack of folded sheets, a continuously driven rotary withdrawing device having a gripper or analogous means for withdrawing successive sheets from the magazine, preferably in such a way that the second marginal portions are located at the lower end of the withdrawn sheet, opening means including first and second mobile opening or spreading devices respectively having first and second clamping means or grippers moving along predetermined first and second paths, straightening means for maintaining the second marginal portions of the first panels of successive withdrawn sheets in the first path for engagement by the first clamping means, and means for moving the straightening means to a retracted position upon engagement of the second marginal portion of the first panel of the withdrawn sheet by the first clamping means to provide room for entry of the second marginal portion of the second panel of the withdrawn sheet into the second path to be engaged by the second clamping means. The first and second clamping means thereupon move apart to open the sheet and are disengaged from the respective second marginal portions to allow the sheet to descend onto a conveyor for transport to or through a further processing station.

The means for moving the straightening means preferably derives motion from the first opening device, i.e., from that opening device whose clamping means serves to engage the projecting second marginal portions of the first panels of successive withdrawn sheets.

The straightening means is preferably provided with a substantially flat surface which engages the second marginal portions of the panels of the withdrawn sheet to hold the projecting marginal portion in the first path prior to movement of the straightening means to the retracted position; such surface is formed with one or more recesses for the clamping means of the first opening device.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
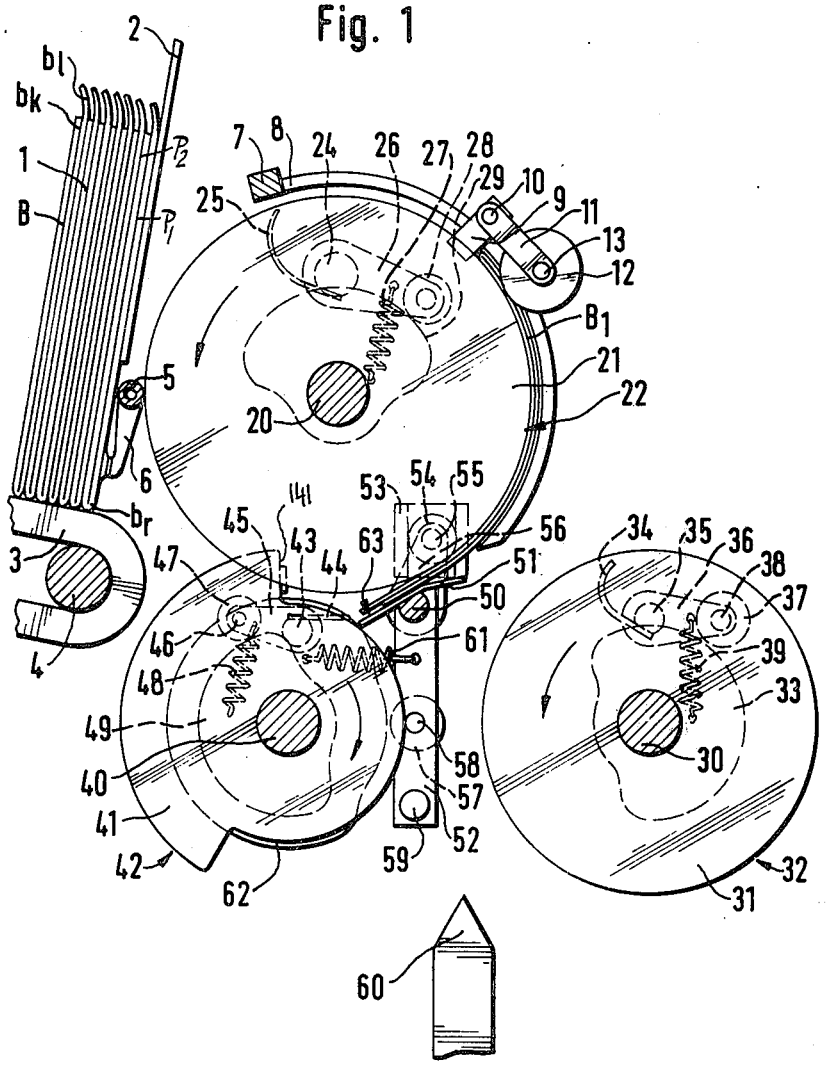
FIG. 1 is a schematic transverse vertical sectional view of an apparatus which embodies the invention, a folded sheet being shown in withdrawn position and the straightening means being shown in the operative position.

Referring to FIG. 1, there is shown a stack 1 of folded sheets B each having a back $b_r$ resting on the upper reach of an endless belt conveyor 3 which constitutes the mobile bottom wall of a magazine. The front wall 2 of the magazine is a sheet metal plate which is in contact with the longest section or panel P1 of the foremost sheet B in the magazine. The upper marginal portions $b_k$ of the smaller panels or sections P2 of sheets B are located at a level below the upper marginal portion $b_1$ of the larger panels P1 of the sheets B. The lower marginal portions of the panels P1, P2 are integral with each other and define the folded back $b_r$ of the respective sheet B.

The lower edge of the front wall 2 is spaced apart from the upper reach of the conveyor 3 to provide an outlet opening for evacuation of successive sheets B from the magazine. The conveyor 3 is trained over a roller 4 and is driven, either intermittently or continuously, to maintain a requisite supply of sheets B adjacent to the front wall 2.

Figure 3:
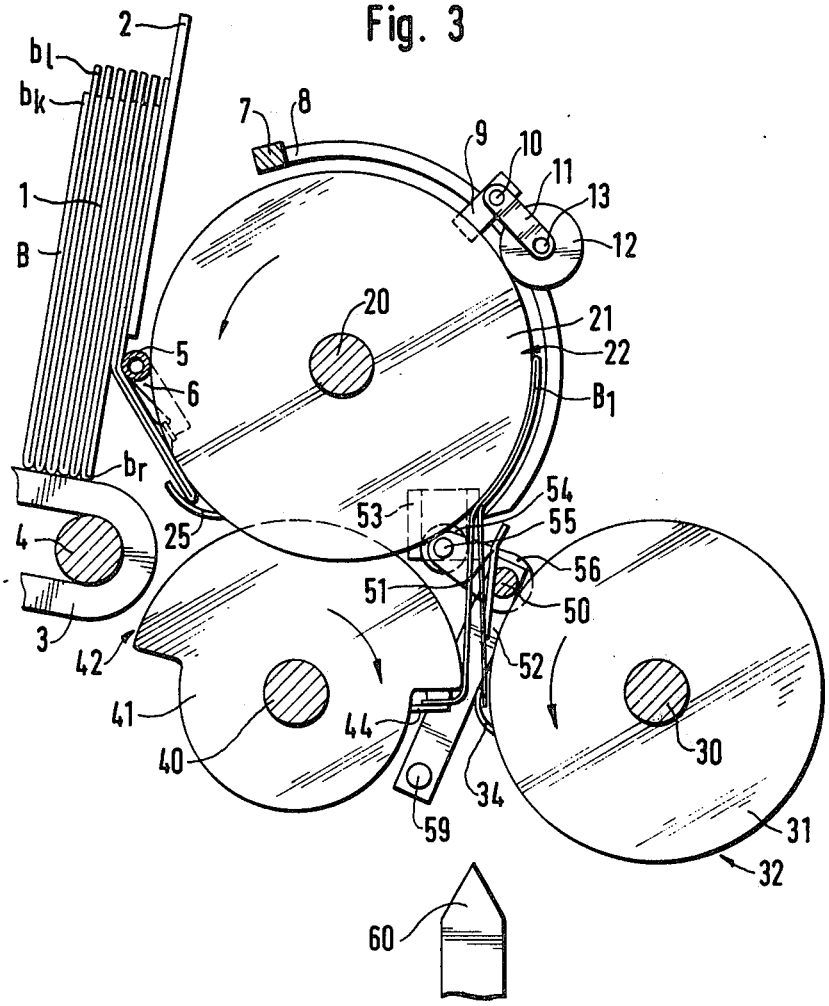
FIG. 3 shows the structure of FIG. 2, with the straightening means in retracted position and the second marginal portion of the second panel of the withdrawn sheet about to be engaged by the second clamping means.

A hollow shaft 5 extends in parallelism with and is adjacent to the lower edge of the front wall 2. This shaft carries one or more sheet transferring elements in the form of suction heads or cups 6 which are pivoted cyclically to move between the end positions shown in FIGS. 1 and 3 and to thereby flex the lower parts of successive foremost sheets B toward a rotary withdrawing device 22. The axial bore of the shaft 5 is connected with a suitable suction generating device (not shown) while the illustrated suction head 6 moves from the position of FIG. 1 to the position of FIG. 3 so that the suction head 6 attracts the adjacent portion of the larger or first panel P1 of the foremost sheet B of the stack 1. The bore of the shaft 5 is thereupon disconnected from the suction generating device to allow the device 22 to withdraw the foremost sheet B from the magazine. The shaft 5 is then rotated in a clockwise direction, as viewed in FIG. 3, to return the suction head 6 to the end position of FIG. 1 in which the suction head engages and attracts the first panel P1 of the foremost sheet B of the stack 1. The shaft 5 is journalled in the two side walls or cheeks (not shown) of the apparatus.

The withdrawing device 22 comprise a shaft 20 which is rotatably mounted in the aforementioned side walls of the apparatus and is continuously driven to rotate in a counterclockwise direction, as viewed in FIG. 1. The shaft 20 is rigid with at least two spaced-apart disk-shaped end walls 21 of the withdrawing device 22. Portions of the end walls 21 are spacedly surrounded by an arcuate cylindrical shroud 8 which is attached to a crosshead or traverse 7. The crosshead 7 extends between and is fixedly connected with the side walls of the apparatus. The center of curvature of the shroud 8 is located on the axis of the shaft 20.

A stationary cam 29 is installed in the space between the end wall 21 of the withdrawing device 22 and has a suitably configurated peripheral cam face which is tracked by a roller follower 28 at the free end of a lever 26 pivotally mounted on a shaft 24 which is parallel to the shaft 20 and is secured to the end walls 21. A spring 27 biases the lever 26 clockwise, as viewed in FIG. 1, to maintain the roller follower 28 in contact with the periphery of the cam 29. The lever 26 carries one or more clamping devices or grippers 25 which are retracted into the space between the end walls 21 during a certain stage of each revolution of the withdrawing device 22 but extend outwardly to clamp the back $b_r$ of the foremost sheet B while the back $b_r$ is held in the position shown in FIG. 3. The means for turning the shaft 5 back and forth to move the suction head 6 between the end positions of FIGS. 1 and 3 preferably comprises a second cam (not shown) which is mounted on and rotates with one of the end walls 21 (or with the shaft 20 if the latter shares the angular movements of the end walls 21) and a lever secured to the shaft 5 and having a roller follower which tracks the second cam. This insures that the back $b_r$ of a sheet B is moved into the range of the withdrawing device 22 when the gripper 25 is about to engage such sheet and thereupon withdraws the sheet from the magazine as the device 22 continues to rotate in a counterclockwise direction.

The shroud 8 carries a pressure roll 12 which may constitute a composite body consisting of a row of coaxial but axially spaced shorter rolls disposed in suitable cutouts or slots of the shroud and bearing against the smaller panel P2 of that folded sheet (marked $B_1$ in FIG. 1) which is completely withdrawn from the magazine and a major portion of which is received in the arcuate clearance or gap between the withdrawing device 22 and the shroud 8. The portions of the pressure roll 12 are adjacent to the peripheral surfaces of the disk-shaped end walls 21 and serve to urge a fully withdrawn sheet $B_1$ against the end walls 21. The roll 12 is rotatable on a shaft 13 whose end portions are mounted in levers 11. These levers are attached to and can pivot (at 10) with respect to bearing members 9 which are adjustably secured to the shroud 8. The bearing members 9 are adjustable in the circumferential direction of the withdrawing device 22 and can be fixedly secured to the shroud 8 in selected positions to thus enable the apparatus to singularize folded sheets of different lengths (as considered in a direction from the back $b_r$ toward the marginal portions $b_1$ and $b_k$). A sheet B which is being withdrawn from the magazine including the conveyor 3 and the front end wall 2 comes to a halt when its back $b_r$ engages the bearing members 9. The gripper 25 is then disengaged from the back $b_r$ of such sheet and continues to move toward the suction head 6 to engage the back of the next foremost sheet B. The cam 29 can cause the lever 26 to disengage the gripper 25 from the sheet B as soon as the back $b_r$ of such sheet moves beyond the pressure roll 12. The sheet B (in the position $B_1$) is then held by the roll 12 in cooperation with the peripheral surfaces of the end walls 21 which move with respect to the sheet but cannot move the sheet beyond the position $B_1$ of FIG. 1 because the back $b_r$ of such sheet abuts against the bearing members 9.

The withdrawing device 22 is mounted at a level above a first rotary entraining or spreading or opening device 41 which comprises a shaft 40 supporting at least two disk-shaped end walls 41. The shaft 40 and/or the end walls 41 are driven to rotate in a clockwise direction, as viewed in FIG. 1. Each end wall 41 comprises a portion of smaller diameter and a portion of larger diameter with two rather pronounced radial shoulders (one shown at 141) between such portions. A stationary cam 49 which is mounted between the end walls 41 has a suitably configurated peripheral cam face which is tracked by a roller follower 47 at the free end of a lever 45 mounted on a shaft 43 which is secured to the end walls 41. The lever 45 is biased by a spring 48 which maintains the roller follower 47 in engagement with the cam 49. The end walls 41 of the spreading or opening device 42 are disposed between the end walls 21 and the shaft 40 is sufficiently close to the shaft 20 to insure that the larger-diameter portions of the end walls 41 extend into the withdrawing device 22 during a certain stage of each revolution of the shaft 40 and end walls 41. The lever 45 carries a clamping device or gripper 44 which can be moved toward or away from the adjacent radial shoulders 141 of the end walls 41 to clamp the projecting marginal portion $b_l$ of the sheet $B_l$ to the entraining device 42.

A secondary rotary entraining or spreading or opening device 32 is adjacent to but spaced from the opening device 42. It comprises two circular disk-shaped end walls 31 rotatable with a shaft 30 which is parallel to the shafts 20, 40 and is journalled in the side walls of the apparatus. A stationary cam 33 between the end walls 31 is tracked by a roller follower 37 on a lever 36 pivotally mounted on a shaft 35 which is attached to the end walls 31. A spring 39 biases the roller follower 37 against the peripheral surface of the cam 33, and the lever 36 carries a clamping device or gripper 34 which can engage the marginal portion $b_k$ of the sheet $B_l$. The reference character 38 denotes the pivot which is provided on the lever 36 to rotatably support the roller follower 37. The gripper 34 can clamp the marginal portion $b_k$ against the peripheral surfaces of the end walls 31.

The opening devices 32, 42 respectively rotate in counterclockwise and clockwise directions, i.e., in and counter to the direction of rotation of the withdrawing device 22.

A shaft 50 is disposed in the space between the withdrawing device 22 and the opening devices 32, 42. This shaft is parallel to the shafts 20, 30, 40 and its end portions are fixedly secured to levers 56 whose free end portions carry pivot pins 55 for rollers 54 which are movable up and down in vertical U-shaped guide members or channels 53 secured to the side walls of the apparatus. The end portions of the shaft 50 are further connected with pivotable levers 52 which extend downwardly into the space between the entraining devices 32, 43. The lower end portions of the levers 52 are provided with pivot pins 59 which are attached to the adjacent side walls of the apparatus. The median portions of the levers 52 carry pins 58 for roller followers 57 which track the suitably configurated peripheral surfaces of cams 62 secured to and rotating with the shaft 40. Springs 61 are provided to bias the roller followers 57 against the respective cams 62. It is often sufficient to provide a single lever 52, a single roller follower 57 and a single cam 62.

The shaft 50 carries a suitably inclined straightening or aligning device 51 which consists of several coplanar sheet metal plates separated by recesses or gaps to provide room for the larger-diameter portions of the end walls 41 and for the gripper or grippers 44. Instead of employing a straightening device which consists of several discrete plate-like sections, the shaft 50 can support a substantially comb-like serrated straightening device which consists of a single piece of metallic or synthetic plastic material and has projections or prongs separated by the recesses or gaps for the parts 41 and 44 of the opening device 42. The straightening device 51 has a flat surface 63 which is substantially tangential to the end walls 21 of the withdrawing device 22 when the device 51 is held in the operative position of FIG. 1.

The operation:

When the parts of the apparatus assume the positions which are shown in FIG. 1, the gripper 25 of the withdrawing device 22 has released a freshly withdrawn sheet $B_l$ and is on its way toward the suction head 6 to engage the foremost sheet B in the magazine 2, 3. The back $b_r$ of the freshly withdrawn sheet $B_l$ abuts against the bearing members 9 and is thus held in a predetermined position with respect to the rotating opening devices 32, 42. The rotating cam 62 maintains the levers 52, 56 in positions which correspond to the operative position of the straightening device 51. In such operative position, the flat surface 63 of the device 51 engages the adjacent marginal portion $b_k$ of the panel $P_2$ of the sheet $B_l$ and also engages the projecting part of the marginal portion $b_l$ to maintain these marginal portions in a plane which is substantially tangential to the end walls 41. Since the panels $P_1$ and $P_2$ of the sheet $B_l$ exhibit at least some tendency to reassume their normal (flat or substantially flat) positions, and since the marginal portions $b_k$ and $b_l$ of the sheet $B_l$ are flexed by the device 51, they lie flat against the surface 63 and the portion $b_l$ is thereby maintained in a predetermined optimum position for engagement by the oncoming gripper 44 of the opening device 42. This insures that possible deformation of the marginal portion $b_l$ (as shown by broken lines at the upper end of the stack 1) is eliminated not later than when the straightening device 51 assumes the operative position of FIG. 1. In other words, the device 51 maintains the marginal portion $b_l$ in an optimum position for engagement by the gripper 44 regardless of whether or not the marginal portion $b_l$ was deformed during the preceding stage or stages of its manipulation ahead of or in the magazine 2, 3 or during withdrawel from the magazine. The opening device 42 rotates in a clockwise direction, as viewed in FIG. 1, and the shoulders 141 of its end walls 41 approach the marginal portion $b_l$ which lies flat against the surface 63 of the straightening device 51.

Figure 2:
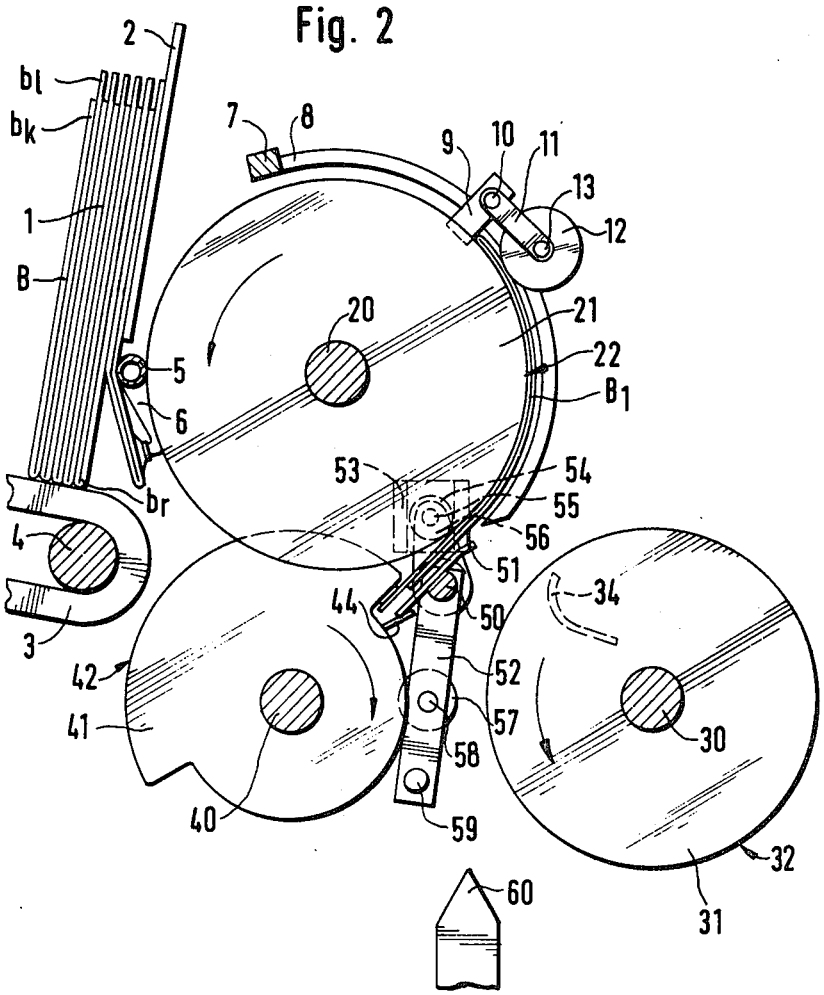
FIG. 2 shows the structure of FIG. 1, with the first clamping means about to engage the projecting marginal portion of the first panel of the withdrawn sheet.

FIG. 2 shows the next stage of movement of the opening device 42. The shoulders 141 contact one side of the marginal portion $b_l$ and the gripper 44 is about to engage the other side of such marginal portion. The gripper 44 emerges from the interior of the opening device 42 by moving through the corresponding slot or recess of the straightening device 51. As soon as the gripper 44 engages the marginal portion $b_l$, the cam 62 pivots the levers 52 to move the straightening device 51 away from the operative position of FIG. 1 to the inoperative or retracted position of FIG. 3 in which the device 51 is remote from the path of the sheet $B_l$. The latter is withdrawn from the gap between the shroud 8 and the withdrawing device 22 by the gripper 44 which cooperates with the shoulders 141. The lower part of the sheet $B_1$ opens up, at least slightly because the gripper 44 moves away from the marginal portion $b_k$ so that the latter is exposed and can be engaged by the gripper 34 of the opening device 32. Once the marginal portion $b_k$ is engaged by the gripper 34, the opening of the sheet $B_1$ proceeds automatically because the grippers 34, 44 continue to move apart. The grippers 34, 44 thereupon release the respective marginal portions $b_1$ and $b_k$ and allow the opened-up sheet $B_1$ to decend onto the conveyor 60 which moves at right angles to the plane of the FIG. 1, 2 or 3 and advances the sheet $B_1$ to the next processing station, e.g., through a gathering unit wherein the sheet $B_1$ is overlapped by additional sheets to form therewith a complete signature or a section of a newspaper.

The next-following sheet B is withdrawn from the magazine and its back $b_r$ is moved into abutment with the bearing members 9 as soon as the gap between the shroud 8 and the withdrawing device 22 is free. This next-following sheet is thereupon manipulated in the same way as described in connection with the sheet $B_1$.

Without further analysis, the foregoing will so fully reveal the gist of the present invention that others can, by applying current knowledge, readily adpat it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. Apparatus for spreading successive sheets of a series of stacked folded sheets wherein each sheet comprises first and second panels having first marginal portions which are integral with each other and second marginal portions substantially parallel to the first marginal portions and wherein the second marginal portion of the first panel projects beyond the second marginal portion of the second panel, comprising a magazine for a stack of folded sheets; a withdrawing device rotatable about an axis and having means for withdrawing successive sheets from said magazine and for advancing each withdrawn sheet to a predetermined position along an arcuate path having a convex side and concave side and for supporting the sheets from the concave side of said path; opening means including first and second spreading devices respectively having first and second clamping means moving along predetermined first and second paths for engaging said marginal portions; straightening means for engaging and maintaining the projecting second marginal portion of the first panel of each sheet occupying said predetermined position in said first path so that such projecting second marginal portion can be engaged by said first clamping means, said straightening means being mounted to move between a predetermined operative position in which said straightening means is located at the convex side of said arcuate path and prevents entry of the second marginal portion of the second panel of a sheet occupying said predetermined position into said second path and a predetermined retracted position in which said straightening means to remote from said arcuate path and provides room for entry of the second marginal portion of the second panel of the sheet in said predetermined position into said second path; and means for moving said straightening means from said operative position to said retracted position upon engagement of the projecting second marginal portion of the first panel of a sheet in said predetermined position by said first clamping means.

2. Apparatus as defined in claim 1, wherein said first spreading device includes a rotary member and said means for moving said straightening means to said retracted position includes an element which rotates synchronously with said member.

3. Apparatus as defined in claim 1, wherein said straightening means has a substantially flat surface which engages the projecting second marginal portion of the sheet occupying said predetermined position to hold such projecting second marginal portion in said first path prior to movement of said straightening means to said retracted position.

4. Apparatus as defined in claim 3, wherein said straightening means has at least one recess for said first clamping means.

5. Apparatus as defined in claim 1, wherein said spreading devices are disposed at a level below said withdrawing device.

6. Apparatus as defined in claim 1, wherein said withdrawing device includes at least one gripper arranged to withdraw successive folded sheets from said magazine in such positions that the first panel of each withdrawn sheet is disposed at the concave side of said arcuate path.

7. Apparatus as defined in claim 1, wherein said straightening means has a substantially flat surface which contacts the sheet occupying said predetermined position and is substantially tangential to said arcuate path prior to movement of said straightening means to said retracted position.

8. Apparatus as defined in claim 1, wherein said spreading devices are rotatable about axes parallel to the axis of said withdrawing device and are spaced apart from each other, said straightening means being disposed between said spreading devices.

9. Apparatus as defined in claim 1, further comprising means for transferring portions of successive folded sheets from said magazine to a position adjacent said withdrawing means.

10. Apparatus as defined in claim 1, wherein said moving means comprises a lever pivotable about a fixed axis and supporting said straightening means, and cam and follower means for pivoting said lever in synchronism with the movement of said spreading devices.

* * * * *